US007624541B2

(12) United States Patent
Gentry

(10) Patent No.: US 7,624,541 B2
(45) Date of Patent: Dec. 1, 2009

(54) GUTTER SYSTEMS

(76) Inventor: David L. Gentry, 18556 SW. Hart Rd., Beaverton, OR (US) 97007

( * ) Notice: Subject to any disclaimer, the term of this patent is extended or adjusted under 35 U.S.C. 154(b) by 291 days.

(21) Appl. No.: 11/122,938

(22) Filed: May 4, 2005

(65) Prior Publication Data

US 2006/0248805 A1 Nov. 9, 2006

(51) Int. Cl.
*E04D 13/00* (2006.01)

(52) U.S. Cl. ..... 52/12; 52/741.1; 248/48.1

(58) Field of Classification Search ..... 52/11, 52/12, 16; 248/48.1, 48.2, 256, 257, 259, 248/260, 265, 271, 272
See application file for complete search history.

(56) References Cited

U.S. PATENT DOCUMENTS

| | | | | | |
|---|---|---|---|---|---|
| 57,813 | A | * | 9/1866 | Yapp | 248/48.2 |
| 546,042 | A | | 9/1895 | Van Horn | |
| 585,471 | A | * | 6/1897 | Hannegan | 248/260 |
| 667,821 | A | * | 2/1901 | Fingles | 52/11 |
| 706,333 | A | * | 8/1902 | Meuser | 52/12 |
| 846,238 | A | | 3/1907 | O'Dowd | |
| 1,000,411 | A | * | 8/1911 | Hyke, Sr. | 248/48.1 |
| 1,047,092 | A | * | 12/1912 | Latham | 248/259 |
| 1,054,914 | A | * | 3/1913 | Gleason | 248/260 |
| 1,267,182 | A | * | 5/1918 | Caron | 248/259 |
| 1,308,311 | A | | 7/1919 | Ward | |
| 1,322,811 | A | * | 11/1919 | Moore | 248/257 |
| 1,502,935 | A | * | 7/1924 | Bohrer | 248/252 |
| 1,808,971 | A | * | 6/1931 | Roberts | 248/259 |
| 1,825,101 | A | * | 9/1931 | Souders | 248/256 |
| 2,072,415 | A | | 3/1937 | Abbitt | |
| 2,144,663 | A | * | 1/1939 | Petersen | 248/48.1 |
| 2,219,953 | A | * | 10/1940 | Fry | 52/12 |
| 2,271,081 | A | | 1/1942 | Layton | |
| 2,284,440 | A | | 5/1942 | Morrissey | |
| 2,674,961 | A | | 4/1954 | Lake | |
| 2,739,775 | A | * | 3/1956 | Bertram | 248/48.1 |
| 2,841,100 | A | | 7/1958 | Moller | |
| 2,895,694 | A | * | 7/1959 | Graving et al. | 248/48.1 |
| 3,047,994 | A | | 8/1962 | Brun | |
| 3,053,393 | A | | 9/1962 | McLean | |
| 3,295,264 | A | | 1/1967 | Olson | |
| 3,351,206 | A | | 11/1967 | Wennerstrom | |
| 3,420,378 | A | | 1/1969 | Turner | |
| 3,436,878 | A | | 4/1969 | Singer | |
| 3,752,428 | A | * | 8/1973 | Trostle et al. | 248/48.2 |
| 4,032,456 | A | | 6/1977 | Berce | |
| 4,036,761 | A | * | 7/1977 | Rankin | 210/474 |
| 4,120,474 | A | * | 10/1978 | Hurley | 248/263 |
| 4,136,847 | A | * | 1/1979 | Murray | 248/256 |
| 4,179,091 | A | * | 12/1979 | Bidney | 248/265 |
| 4,307,976 | A | | 12/1981 | Butler | |
| 4,314,683 | A | * | 2/1982 | Cunning | 248/48.2 |
| 4,351,134 | A | * | 9/1982 | Clarkson | 52/12 |
| 4,404,775 | A | | 9/1983 | Demartini | |
| 4,467,570 | A | * | 8/1984 | Kriegel | 52/12 |
| 4,553,357 | A | * | 11/1985 | Pepper | 52/12 |

(Continued)

*Primary Examiner*—Richard E Chilcot, Jr.
*Assistant Examiner*—Brent W Herring
(74) *Attorney, Agent, or Firm*—Dascenzo Intellectual Property Law, P.C.

(57) ABSTRACT

Gutter systems, including a gutter protector and/or a gutter protector support. The gutter protector may help to reduce or eliminate the introduction and/or accumulation of leaves, tree needles, and/or other debris in the gutter system.

9 Claims, 3 Drawing Sheets

U.S. PATENT DOCUMENTS 4,592,174 A * 6/1986 Hileman ..... 52/12
4,631,875 A * 12/1986 Olson ..... 52/12
4,644,704 A 2/1987 Pedgonay
4,646,488 A 3/1987 Burns
4,745,710 A 5/1988 Davis
4,769,957 A 9/1988 Knowles
4,841,686 A * 6/1989 Rees ..... 52/12
4,866,890 A 9/1989 Otto
4,888,920 A * 12/1989 Marulic ..... 52/12
4,907,381 A 3/1990 Ealer
4,959,932 A 10/1990 Pfeifer
5,010,696 A 4/1991 Knittel
5,044,581 A 9/1991 Dressler
5,056,276 A 10/1991 Nielsen et al.
5,072,551 A 12/1991 Manoogian, Jr.
5,092,086 A * 3/1992 Rognsvoog, Sr. ..... 52/12
5,095,666 A * 3/1992 Williams, Jr. ..... 52/11
5,109,640 A 5/1992 Creson
5,257,482 A 11/1993 Sichel
5,271,192 A 12/1993 Nothum, Sr. et al.
5,321,920 A * 6/1994 Sichel ..... 52/12
5,388,377 A 2/1995 Faulkner
5,398,464 A * 3/1995 Jacobs ..... 52/12
5,406,754 A * 4/1995 Cosby ..... 52/12
5,438,803 A * 8/1995 Blizard, Jr. ..... 52/12
5,555,680 A * 9/1996 Sweers ..... 52/12
5,617,678 A * 4/1997 Morandin et al. ..... 52/11
5,619,825 A 4/1997 Leroney et al.
5,623,787 A 4/1997 Ali
5,729,931 A 3/1998 Wade
5,848,857 A * 12/1998 Killworth et al. ..... 405/118
5,884,876 A * 3/1999 Axford ..... 248/48.2
5,893,240 A * 4/1999 Ealer, Sr. ..... 52/12
5,956,904 A * 9/1999 Gentry ..... 52/12
6,067,755 A * 5/2000 Maanum ..... 52/12
6,134,843 A * 10/2000 Tregear ..... 52/12
6,135,403 A * 10/2000 Goldstein ..... 248/253
6,168,125 B1 * 1/2001 Winger et al. ..... 248/228.3
6,205,715 B1 * 3/2001 Rex, Jr. ..... 52/12
6,209,826 B1 4/2001 Pratt, Jr.
6,594,956 B1 * 7/2003 Willing ..... 52/11
6,681,527 B2 1/2004 Baker
6,944,991 B2 * 9/2005 Kim ..... 52/11
6,968,665 B2 * 11/2005 Lawson ..... 52/745.2
7,310,912 B2 * 12/2007 Lenney et al. ..... 52/12
2004/0003549 A1 * 1/2004 Lawson ..... 52/168
2005/0097826 A1 * 5/2005 Fox ..... 52/12
2005/0115158 A1 * 6/2005 Brown ..... 52/11
2005/0204641 A1 * 9/2005 Collister et al. ..... 52/11
2006/0225366 A1 * 10/2006 Loveless ..... 52/11
2007/0017162 A1 * 1/2007 Staub ..... 52/11
2007/0204521 A1 * 9/2007 Jackson et al. ..... 52/11

* cited by examiner

Fig. 1
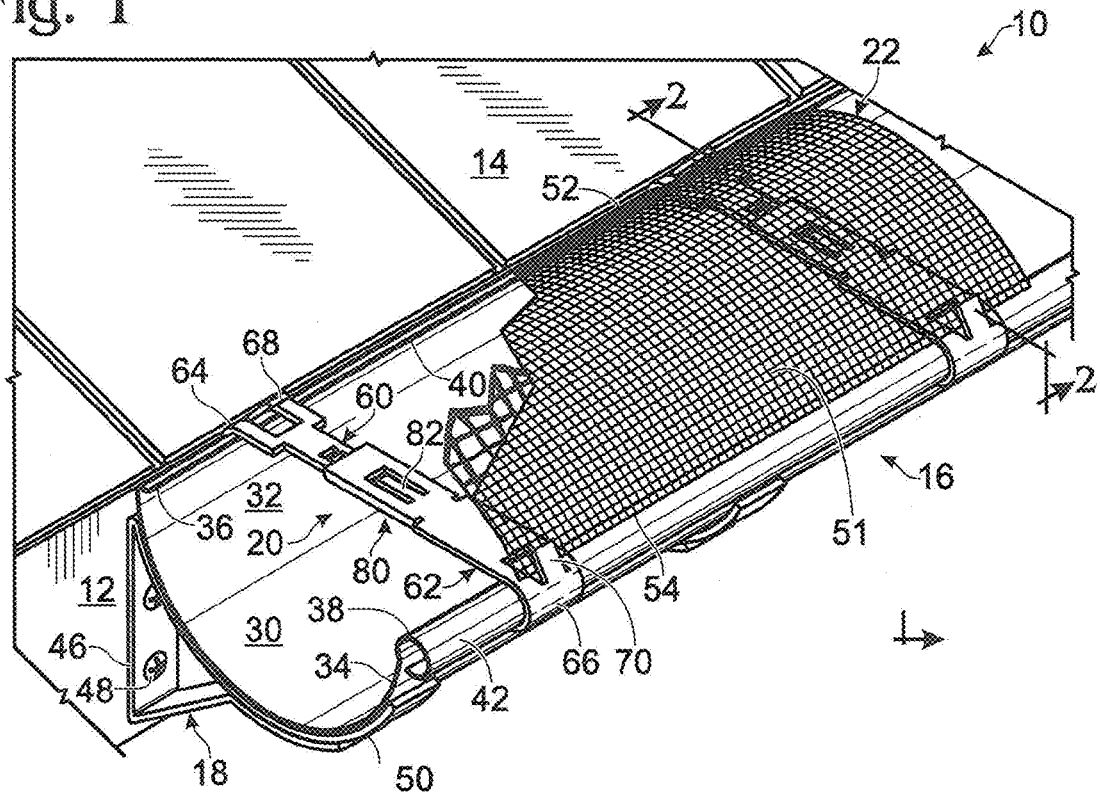
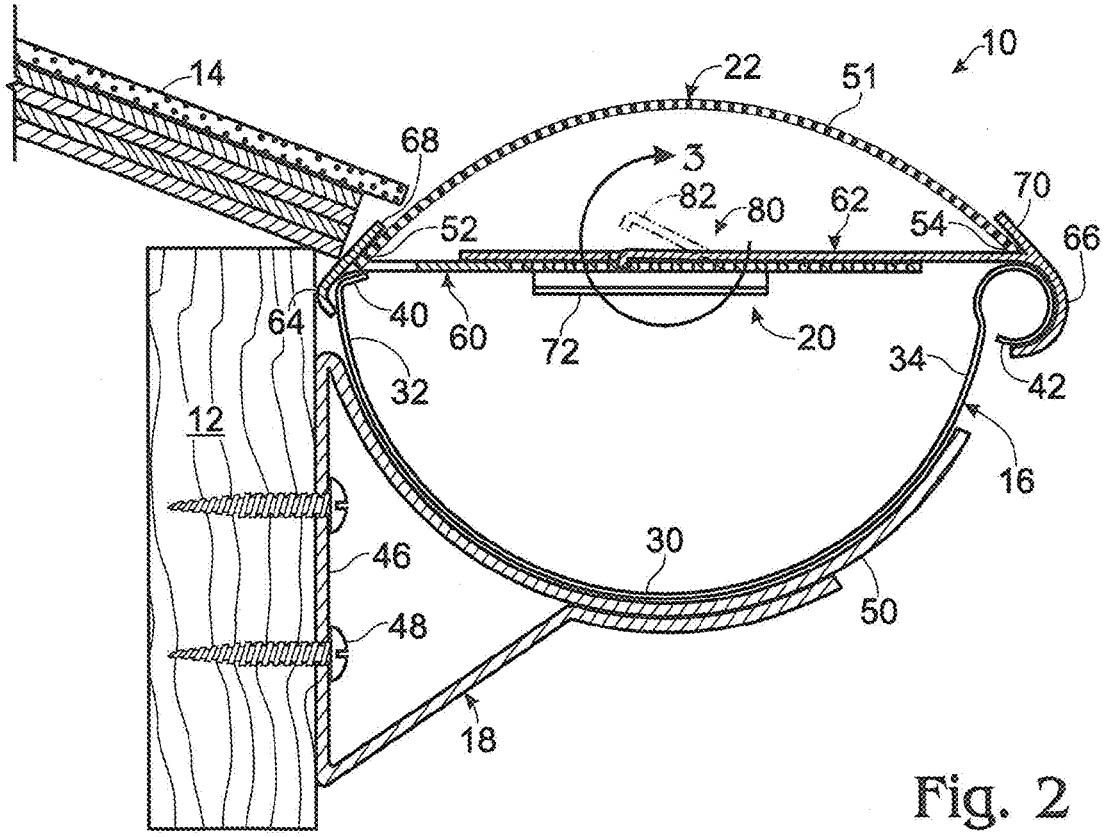
Fig. 2

GUTTER SYSTEMS

Gutter systems often are attached to buildings to collect and carry away free-flowing precipitation, such as rainwater, from all or a portion of a building. Gutter systems typically include gutters, or gutter assemblies, and downspouts. Gutter assemblies are commonly attached along the edge of a building's roof such that precipitation, including rainwater, flows off of the roof and collects in the gutters. The gutters collect the precipitation into downspouts, which deposit the water to a location away from the building's foundation. Thus, a free-flowing gutter system reduces or prevents the accumulation of precipitation on the building's roof, or around the building's foundation.

A common problem with gutter systems is that they become blocked. One or more portions of a gutter system may accumulate debris, such as leaves and twigs, which block the flow of precipitation in the gutter or in the downspout. Blockage in any part of a gutter system may prevent the proper evacuation of precipitation, which may lead to significant water-associated structural damage to a building. The prevention of gutter system blockage by common debris can require periodic cleaning and maintenance. Such cleaning and maintenance of gutters, particularly those located at the roofline, is a difficult, inconvenient, and potentially dangerous activity.

Efforts have been made to develop gutter systems that include devices to prevent blockage and accumulation of debris. A gutter assembly including a mesh gutter protector is disclosed in U.S. Pat. No. 5,956,904 ("the '904 patent,") to the inventor of the present application, David L. Gentry, issued Sep. 29, 1999, which is incorporated herein by reference. The '904 patent provides a gutter assembly with a mesh protector that is held in place over a gutter. When installed, a portion of the protector is positioned inside the gutter, and the protector is at least partially supported by a spike extending through the gutter.

SUMMARY

The present teachings provide gutter systems, including a gutter protector and/or a gutter protector support. The gutter protector may help to reduce or eliminate the introduction and/or accumulation of leaves, tree needles, and/or other debris in the gutter system.

BRIEF DESCRIPTION OF THE DRAWINGS

FIG. 1 is an environmental view of a gutter system, including a gutter protector and a protector support, in accordance with aspects of the present teachings.

FIG. 2 is a sectional environmental view of the protector support of FIG. 1, taken generally along line 2-2 in FIG. 1, in accordance with aspects of the present teachings.

DETAILED DESCRIPTION

Figure 3:
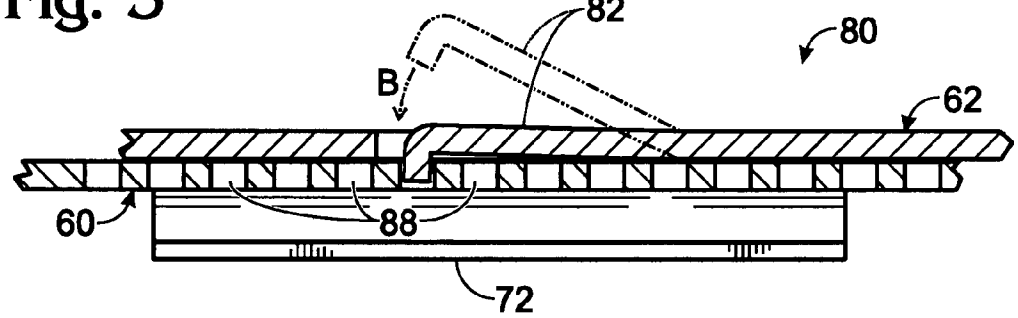
FIG. 3 is an expanded sectional view of the protector support of FIG. 2 fragmented approximately as shown in FIG. 2 along detail circle 3, in accordance with aspects of the present teachings.

The present teachings provide gutter systems, including components and methods of use thereof. These systems may include (1) a gutter, (2) a gutter protector, and/or (3) a protector support, among others. The gutter protector may help to reduce or eliminate the introduction and/or accumulation of leaves, tree needles, and/or other debris in the gutter system. The gutter protector may have a number of advantages, including the ability to fit gutters of various sizes. These and other aspects of the present disclosure are described, in detail, in the following sections: (I) gutters, (II) gutter protectors, (III) protector supports, (IV) methods of installation and use, and (V) examples.

I. Gutters

Gutters generally include systems such as trough or channel systems that may run along or be attached to buildings to divert or carry away precipitation, including rainwater, from a building surface, such as a roof, and from a building's foundation. It is often desirous to include gutters on a building to prevent excessive precipitation accumulation on a building surface, or foundation, which may cause damage. Gutters may be connected to one or more downspouts, or outlets to form a gutter system. The outlets, in turn, may drain into one or more areas capable of distributing liquid away from a building, such as splash blocks, or underground conduits. Gutters alternatively or additionally may be termed eaves spouts or eaves troughs (particularly in New England and the Great Lakes states), and/or spouting or rainspouts (particularly in New Jersey, eastern Pennsylvania, and the Delmarva Peninsula).

Gutters may be configured to receive precipitation from a building or other surface and direct the precipitation to a downspout. The gutters may include a concavity, or trough, with an open top. The trough may be formed between two or more gutter walls. The trough may define the orientation of the gutter, such that the open top of the trough is the top of the gutter, and the concavity of the trough defines the inside, or interior, of the gutter. Therefore, the opposing bottom and the outside, or exterior, of the gutter also may be defined. The gutter may be positioned on a building or other structure in an orientation such that the gutter top, or open top of the gutter trough, receives precipitation flowing off the roof or other building surface.

The trough may be configured, shaped, or slanted, to receive a volume of precipitation, and direct the precipitation to one or more downspouts. Accordingly, gutters may be of various cross-sectional shapes. Suitable cross-sectional shapes may include half-round, quarter round, "k-shaped," curved, ogee shaped, "u-shaped," "v-shaped," boxed shaped, and/or any combination thereof.

The gutter walls may terminate in edges, or lips at the top of the gutter. Furthermore, one or more of the gutter wall edges, or gutter lips, may include a round protrusion, or a bead. Such a bead may lie on the interior and/or exterior side of the gutter wall. Beads may be useful in directing rainwater inside of the gutter trough, assisting in gutter positioning onto a building, assisting in the retention of other portions of a gutter assembly onto the gutter assembly. Alternatively, or in addition, the beads may serve as a purely decorative feature. Although typically round, the beads more generally may have any shape, including an oblong, a protracted ledge, or a substantially flattened ridge. Further, gutter walls on the same gutter may include different sized and shaped beads.

Gutters may have any suitable size. A gutter's size may be predetermined, such that the gutter size is determined at the time of gutter manufacture, or subsequent assembly, or the gutter size may be adjustable to a range of sizes after manufacture is completed. A gutter's size may be calculated by measuring the linear distance between two gutter lips at the top of a gutter trough, or rather, the linear distance between the two gutter walls at the trough opening. The linear distance used to size the gutter may be determined and reported in inches, centimeters, or any other unit of linear measurement. Gutters may have sizes in a range, for example, 1 to 20 inches, or 2 to 12 inches, or 2 to 6 inches, among others. Exemplary sizes may include 4 inches, 5 inches, 6 inches, 7 inches, and 8 inches, among others.

The size of gutter used on the building may be determined, in part, by the predicted amount of rainwater to which the building will be exposed, depending, for example, on a building's size and geographic location. For instance, a large roof may require a gutter of a larger size, whereas a small roof may allow use of a gutter of a smaller size. Gutters used on residential houses may be sized in the range of two to six inches, and gutters for commercial use may be of even larger size.

Gutters may be formed of any suitable material(s). These materials typically will be capable of maintaining a desired shape, conducting a flow of liquid, and withstanding exposed weather conditions. Suitable materials may include metal (e.g., copper, zinc, (galvanized or stainless) steel, aluminum, and so on), plastic (e.g., vinyl, fiberglass, and so on), and/or wood, among others, and combinations thereof. Gutters may be constructed out of the same and/or different materials as the connected downspouts with which they may communicate in a gutter system.

Gutters and other portions of the gutter system may be attached to a structure, such as a building, patio, deck, gazebo, and so on, using any suitable mechanism(s). These mechanisms may include fasteners, such as nails, spikes, staples, rivets, ring shanks, screws, brads, hangers, straps, and/or a variety of retention devices, which may directly and/or indirectly join one or more gutters to a building. Some gutter fasteners, such as gutter hangers, may only contact a gutter's exterior surfaces, whereas other gutter fasteners, such as spikes, also may be present inside the gutter, or even go through the gutter's interior. More than one type of fastener may be used to attach gutters within the same gutter system.

Further aspects of gutters, particularly those suitable for use with gutter protectors and gutter protector supports, are described below in the Examples.

II. Gutter Protectors

Gutter protectors generally include any mechanism(s) for reducing or preventing the introduction and accumulation of unwanted debris inside the gutter trough, and the concomitant blockage of fluid flow through the gutter system. A gutter protector may operate to prevent or retard debris, such as leaves, dirt and twigs, from entering into the trough, while at the same time permitting precipitation to flow into the gutter trough.

Gutter protectors may cover all, or a portion of, a gutter trough. Types of gutter protectors include solid deflectors, caps, mesh screens, grids, and/or combinations thereof. Further, protectors including mesh screens may consist of one, two, or multiple layers of mesh screen. Gutter protectors may be formed of any suitable materials, including those described above for gutters, such as copper, steel, aluminum, vinyl, and/or the like.

Gutter protectors may be placed along any portion(s) of a gutter where the protector may serve physically to block debris from entering into a gutter trough. Some gutter protectors may be placed alongside a gutter, whereas other gutter protectors may be placed over substantially the entire top of a gutter. Regardless of the position, such gutter protectors may serve physically to restrict solid materials from entering into the gutter trough.

Gutter protectors may be of various forms, sizes, and shapes, which may be partially dependent on the type of gutter protector, and/or the size and shape of the gutters to be protected in the gutter assembly. Protectors may include one or more gutter protector edges. Portions of these protector edges may be directly or indirectly attached to a gutter.

Further aspects of protectors, particularly those suitable for use with protector supports having sliding articulations, are described below in the Examples.

III. Protector Supports

Protector supports, also termed gutter protector supports, or simply supports, may be used to position and retain a gutter protector, or protector, over a gutter. Protector supports may attach to both a protector and a gutter. Thus, a protector support may function to indirectly attach a protector to a gutter. Consequently, due to this intermediary connector function, the configuration of a protector support may be determined at least in part by the size, shape, and configuration of both the protector and the gutter which is to be protected.

Protector supports may be configured to receive one or more portions of a gutter protector. As such, the supports may include features such as stays or openings that are sized and shaped to accommodate and retain all or part of a gutter protector. Such stays may include tabs, extensions, members, and/or the like, and such openings may include slots, grooves, and/or other apertures, all adapted directly to receive and retain a protector. Alternatively, or in addition, protector supports may include fasteners such as clips, spikes, or screws adapted indirectly to receive and retain a protector.

Protector supports further may be configured to fit over or receive one or more portions of a gutter with which the gutter protector will be affiliated in a gutter assembly. The supports may include one or more curvatures, openings, slots, apertures, ridges, grooves, and/or the like sized and shaped to accommodate or affix to one or more portions of a gutter. Portions of the gutter with which the support may be affixed include gutter walls, lips, beads, and/or troughs. The protector support may fit over and affix to the gutter without fasteners, adhesives, and/or the like, for example, by being adjusted to engage features of the gutter (such as lips), such that the protector cannot be removed without taking it at least partially apart. The protector support may attach to the gutter such that it is affixed at least substantially about, above, and/or exterior to the gutter, particularly the opening of the gutter configured to receive water.

The supports may be adjustable so as to fit a variety of protectors and gutter sizes and shapes. Protector supports may include an adjustable articulation. The adjustable articulation may be configured so that the length, or size, of the protector support may be adjusted to fit a range of gutter sizes. The adjustable articulation may be formed by two or more support members that slidably articulate with each other, such that, upon sliding, the overall length of the support, or support length, may be altered. Alternatively, or in addition, the adjustable articulation may include a compression body and/or any other device capable of adjustment, which may be manipulated to adjust a support length.

An adjustable support may be fixed at a desired length. Once a desired support length is achieved, the support length may be fixed, or locked. Such fixation may occur by a fixation fastener that is either intrinsic, or internal, to the support, such that manipulation of a portion of the support fixes the support length, or alternatively, by extrinsic, or external, to the support. As the adjustable articulation may include a slidable junction between two support members, this slidable junction may be fixed in position by any suitable retention mechanism. The retention mechanism may provide a continuous range of support length of fixed positions, or alternatively, only discrete locked positions.

Retention mechanisms used to lock protector supports may include a fastener, such as a pin (or pins) sized and shaped to be received into a slot. The pin may be included in a first support member, and the slot (or slots) may be included in a second support member, such that when the pin of the first member is positioned within the slot of the second member, the first and second members are prevented or biased away from moving relative to each other. In this manner, the length of the support member may be fixed. In other embodiments, the fixation mechanism, or the linear movement fixation mechanism, may be a screw sized to be positioned within a slot defined by one or more support members, or a tab or button that may be bent, depressed, or otherwise moved into a retaining slot or locking position, among others.

Fixation at a desired support length may be either reversible or irreversible. If reversible, the mechanism fixing the support at a first support length may be released, displaced, loosened, or otherwise released, and the support may again be adjustable. After such a release, the support may be adjusted to a second support length, which may again be releasably fixed. Reversibility may allow the protector to be resized and/or repositioned during a given installation, and/or removed after a first installation and used later in a subsequent installation.

Protector supports generally may be formed from any suitable material capable of maintaining a fixed configuration while maintaining a protector on a gutter. Such materials may include those described above for gutters, including copper, steel, aluminum, vinyl, and/or the like.

Further aspects of adjustable protector supports, particularly those having sliding articulations, are described below in the Examples.

IV. Methods of Installation and Use

Gutter assemblies, particularly those with adjustable protector supports, as described herein, may be assembled and/or used using any suitable method or procedure. For example, a gutter system installer, or end user, may (1) select a gutter having a predetermined size, in accordance with the specifications of the building to which a gutter assembly is to be attached, the volume of fluid the gutter is expected to handle, and so on, (2) select a gutter protector and gutter protector support consistent with the size and configuration of the gutter, (3) attach the gutter to the building, (4) adjust the protector support to a support length at which the support may be secured to the gutter, (5) fix the protector support at the support length, (6) attach the protector support to the gutter, and (6) attach the gutter protector to the protector support, so that the gutter protector is indirectly attached to the gutter, via the support, and the gutter protector is in position to protect the gutter from the intrusion on debris. These steps, or a subset thereof, may be performed manually and/or mechanically, and may include the use of a guided system. Further, these steps may be carried out any suitable number of times, in any suitable order, including simultaneously.

V. EXAMPLES

The following examples describe selected aspects and embodiments of the present teachings, including, among others, (1) gutter systems with gutter protectors and adjustable protector supports, and (2) exemplary uses of such systems, particularly uses of adjustable protector supports to support gutter protectors on gutters. These examples are included for illustration and are not intended to limit or define the entire scope of the present teachings.

Example 1

Exemplary Gutter Assembly with Gutter Protector and Adjustable Protector Support This example describes an exemplary gutter assembly, in accordance with aspects of the present teachings; see FIGS. 1-3.

FIG. 1 shows a portion of a gutter assembly 10. The gutter assembly may be installed on a structure such that it can catch and channel runoff from the structure, for example, by positioning the assembly adjacent a fascia board 12 that, in turn, is situated below a roof edge 14. The gutter assembly may include a gutter 16 affixed to the fascia board by a gutter hanger 18, a protector support 20, and a gutter protector 22.

The gutter may have any suitable size(s), shape(s), and/or style(s). However, in each case, the gutter may include a gutter trough 30, or cavity, configured to receive rainwater flowing off of the roof edge 14. The gutter trough 30 may be formed between a first gutter wall 32 and a second gutter wall 34. Generally, one of the first and second gutter walls will face toward the fascia board, and associated building or structure, while the other of the first and second gutter walls will face away from the fascia board, and associated building or structure. The gutter may have a semi- or hemi-circular profile, such as a half-round profile, among others. The first and/or second wall may terminate in lips, e.g., a first lip 36 and/or a second lip 38, such that the lips define the opening of trough 30. The first and/or second lip, in turn, further may include a bead, e.g., a first bead 40 and/or a second bead 42, respectively. Here, first bead 40 is depicted as a straight ledge projecting into gutter trough 30, and second bead 42 is depicted as a rounded protuberance substantially projecting outside of the gutter trough to the gutter exterior. More generally, the beads of the gutter wall can have any suitable sizes, shapes, and/or projections.

The gutter may be attached to fascia board 12 by any suitable mechanism(s), such as one or more gutter hangers 18. A gutter hanger may include any device, fastener, or clip capable of maintaining a gutter 16 of a gutter assembly 10 in position on a building. The gutter hanger may include a retention face portion 46 configured directly to engage the fascia board. The retention face portion may be affixed to the fascia using retention face fasteners 48, such as screws, nails, spikes, or clips. The gutter hanger further may include a cradle portion 50 that may be configured to receive the gutter. Cradle portion 50 may be configured to include a concavity that substantially matches the convexity of the gutter trough, as depicted in FIG. 1. Alternatively, the cradle portion may be substantially flat, boxed, or convex.

The gutter may be fastened to any suitable portion(s) of the gutter hanger. For example, the gutter may be fastened to the gutter hanger retention portion, to the gutter hanger cradle portion, and/or to any other gutter hanger portion capable of joining the gutter to the gutter hanger. Fasteners, including screws, brads, rivets, or clips, may be used to fasten any portion of the gutter to any portion of the gutter hanger so as to position and retain the gutter in a desired location on the fascia board.

Gutter assembly 10 may include a gutter protector 22 capable of at least partially protecting the gutter 16 from the intrusion of debris, including leaves and twigs, as discussed above. The gutter protector 22 may include, among others, a protection portion 51, a first protector edge portion 52, and a second protector edge portion 54.

The protection portion may include at least one mesh screen. The mesh screen may be capable of retaining its shape and withstanding ordinary loads resulting from wind, rain, snow, ice, or accumulated debris. The mesh of protector 22 may be a fine mesh, which has openings that are small enough to block fine debris, such as coniferous needles, yet large enough to permit water to flow freely through gutter screen protector 22 and into gutter 16. The mesh screen of protector 22 may be manufactured from metal, fabric, vinyl, and/or combinations thereof, among others. Thus, protector 22 may be formed of any material and in any configuration that retains its shape, is sturdy enough to resist the previously mentioned forces, and is capable of screening, or filtering, debris while allowing water to freely flow into gutter 16.

The gutter protector also may be deformable, preferably elastically deformable, such that it may be compressed from its uncompressed rest state by pressure, for example, from a user's hands. As such, in an uncompressed state, protector 22 may be curved about an axis that is parallel to the edge portions, so that the top surface of the fabric screen is convex and generally semi-cylindrical. A compressed state may be achieved by compressing the gutter protector to cause the first and second edge portions 50 and 52 to move toward each other. In such a compressed state, the edge portions may exert an outward pressure as the elastically deformed gutter protector attempts to return to its uncompressed rest state. The outward pressure may serve at least partially to position the gutter protector over the gutter.

Gutter assembly 10 further may include one or more protector supports 20 configured to position and/or retain gutter protector 22 over gutter 16. The protector support may include features adapted to engage one or more portions of gutter 16, and features adapted to engage one or more portions of gutter protector 22, particularly because the protector support may act as an intermediary retention device positioned operatively between the gutter and gutter protector.

Protector support 20, accordingly, may include a first and a second retention curve, 64 and 66, each configured to receive all or a portion of a gutter lip, 36 and 38. Further, the first and/or second retention curve may partially circumscribe the outside of either the first or second gutter lip. In this manner, the protector support may attach to the outside of gutter 16, such that no portion, or only a small portion, of the protector support lies within the inside of the gutter, or rather, within the gutter trough 30.

Protector support 20 further may include a first and a second stay, 68 and 70, each configured to retain a portion of a protector edge, 52 or 54. The first and/or the second stay may be an upwardly slated protrusion, a clip, a fastener, or any catch which exerts a pressure onto a protector edge, so as to retain the protector on the protector support. The pressure exerted by the stay of the protector support may move the protector edge toward the opposing protector edge. Thus, together, the first and second stays may retain the first and second protector edges onto the protector support and maintain the protector in a compressed state over the gutter.

Protector support 20 may be formed from a first support member 60 and a second support member 62, which may be adjacent or even connected to each other at an interconnection 80. Interconnection 80 may permit a user to slidably adjust, or move the first and second support members relative to one another, along a line or in the same plane. Such linear adjustment of the first and/or second support members may modify, change, or adjust a support length, or overall length, or linear measurement, of the protector support. One reason for adjusting the support length may be to adjust the protector support to a length that may securely fit onto a particular gutter, such as a gutter with a predetermined measurement spanning a distance between the first gutter lip 36 and the second gutter lip 38. An adjustable interconnection portion may permit the protector support to be used to retain a gutter protector over a variety of gutter sizes. The interconnection portion may include an adjustment arm 82, lock, or other fixation member that, when in an engaged configuration, may fix or lock interconnection portion 80 into a non-adjustable or non-slidable configuration.

FIG. 2 shows a sectional view of gutter assembly 10. As shown in this view, interconnection 80, the region in which first support member 60 and second support member 62 are interconnected, may involve a portion of the first support member being received into a channel portion 72 of the second support member. Channel portion 72 may guide a portion of the first support member to overlap with, or slide along, a portion of the second support member. While FIG. 2 shows that channel portion 72 is located on the second support member, in other embodiments, such a channel, or guide portion, may alternatively, or in addition, be located on the first support member to receive a portion of the second support member in slidable interconnection.

The first and second stay, 68 and 70 of protector support 20 may be angled, or slanted relative to the plane of the protector support. The angle or slant of a stay may assist in shaping the compressed protector into a dome-shape covering of the gutter trough. While the first and second stay shown in FIG. 2 are angled so as to retain the protector in protruded dome shape, other embodiments may include stays or stops that are angled or positioned so as to retain a protector relatively flat, lying along the plane of the protector support, and/or along the top of the gutter opening.

FIG. 3 is a detailed view, taken along detail circle 3 of FIG. 2, which shows in greater detail the overlap of the first support member 60 and the second support member 62 at interconnection 80. In an engaged overlapped configuration (shown with the adjustment arm in solid lines), adjustment arm 82 of the second support member may be engaged with or positioned into a slot 88 located in the overlapping first support member, retarding or preventing their relative sliding motion. In a disengaged, potentially overlapped configuration (shown with the adjustment arm in dashed lines), adjustment arm 82 is disengaged from or positioned out of a slot locating in the first support member.

The ability to engage or disengage the first and second support members allows the length of the protector support to be fixed or adjusted, respectively. In particular, when the adjustment arm is in an engaged configuration, the length of the protector support 20 may be fixed. Alternatively, when the adjustment arm is in a disengaged configuration, the length of protector support 20, or support length, may be slidably adjusted. In some embodiments, adjustment arm 82 may be freely moved between an engaged configuration and a disengaged configuration, and thus, the support length may be repeatedly modified, or changed, by repeated slidable adjustments of the first support member relative to the second support member and repeated releasable fixation engagements. Alternatively, other embodiments may include an adjustment arm, or adjustment device, which may only be fixedly engaged once, such that once the adjustment arm assumes an engaged configuration, the engagement may not be released.

Example 2

Exemplary Adjustable Protector Support

This example describes further aspects of an exemplary protector support, in accordance with aspects of the present teachings; see FIGS. 4A, 4B, 5A, 5B, and 6.

Figure 4A:
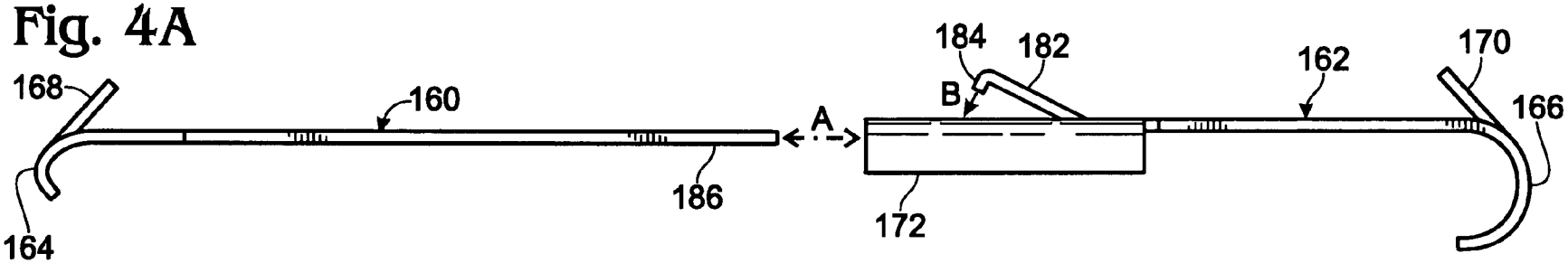
FIG. 4A is a side elevation view of the protector support of FIG. 1, showing portions of the support disengaged, in accordance with aspects of the present teachings.
Figure 4B:
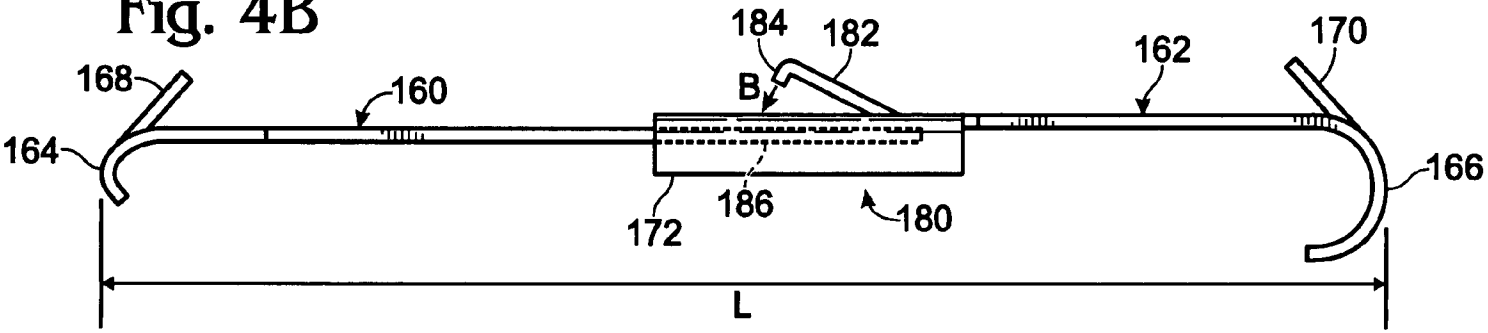
FIG. 4B is an alternative side elevation view of the protector support of FIG. 1, showing portions of the support engaged, in accordance with aspects of the present teachings.

FIGS. 4A and 4B (side views) and 5A and 5B (top views) show two exemplary configurations of an exemplary adjustable protector support. The exemplary gutter protector may include a first support member 160 and a second support member 162. The first and second support members, in turn, may include a first retention curve 164 and a second retention curve 166, respectively, configured to receive portions of a gutter lip, for example, to affix the support members to the gutter. The first and second support members also may include a first stay 168 and a second stay 170, respectively, configured to receive and retain portions of a gutter protector.

The first and second support members may be configured for adjustable (e.g., slidable) engagement, for example, to allow the size of the protector support to be adjusted to fit a gutter and/or gutter protector (or a variety of gutters and/or gutter protectors). Toward this end, first support member 160 may include a slot portion 186, and second support member may include a channel portion 172, or vice versa, adapted for slidable interconnection. These portions may be joined by relative movement, with any desired degree of overlap, as indicated by Arrow A in FIGS. 4A and 5A, and by the visible differences in configuration between FIGS. 4A and 4B, and between FIGS. 5A and 5B. The slot portion of the first support member and the channel portion of the second support member, when so joined or interconnected, may create an interconnection portion 180 of protector support 120. In this interconnected configuration (FIG. 4B), the protector support has a support length that may be indicated by a length L. Support length L may be adjusted upon slidable adjustment of slot portion 186 relative to channel portion 172. In some embodiments, support length L may be reduced by slidable movement of the first and second support members toward one another, and support length L may be increased by slidable movement of the first and second support members away from one another.

The first and second support members may include one or more locking mechanisms for fixing the relative positions of the members. These locking mechanisms may be reversible or irreversible, and may involve adhesives, mechanical deformation such as crimping or bending, and/or mating structures such as slot and pin, screw or rivet and hole, and so on. For example, these locking mechanisms may include an adjustment arm 182, disposed on a side of channel 174. In FIGS. 4A and 4B, the adjustment arm is shown in a disengaged configuration. The disengaged configuration of adjustment arm 182 may permit the slidable adjustment of slot portion 186 relative to channel portion 172 (e.g., as shown by Arrow A). The disengaged configuration shown in FIGS. 4A and 4B is a configuration in which the adjustment arm is partially separated, or moved away from, the plane of second support member 160. In other embodiments, the disengaged configuration may be configurations in which the adjustment arm is depressed relative to the plane of the second support member, or where the adjustment arm is completely detached from the first member in a disengaged configuration, among others. In yet other embodiments, the adjustment arm may be located on portions of the protector support other than the channel portion, including on the slot portion of the second support member.

Adjustment arm 182 further may include a pin 184, which may be sized, configured, and positioned to be received into a slot 188 of slot portion 186. In an engaged position, the adjustment arm may be displaced in the direction of Arrow B. Such displacement in the direction of Arrow B may bring the pin of adjustment arm at least partially into the channel 174 of channel portion 172. If slot portion 186 is inside the channel when pin 184 enters, the pin may be received within a slot of the slot portion, and thus the pin may lock the slot portion in position inside of the channel. Thus, in an engaged configuration, pin 184 of adjustment arm 182 is engaged within a slot of slot portion 186, thereby preventing slidable movement of the support members.

Figure 5A:
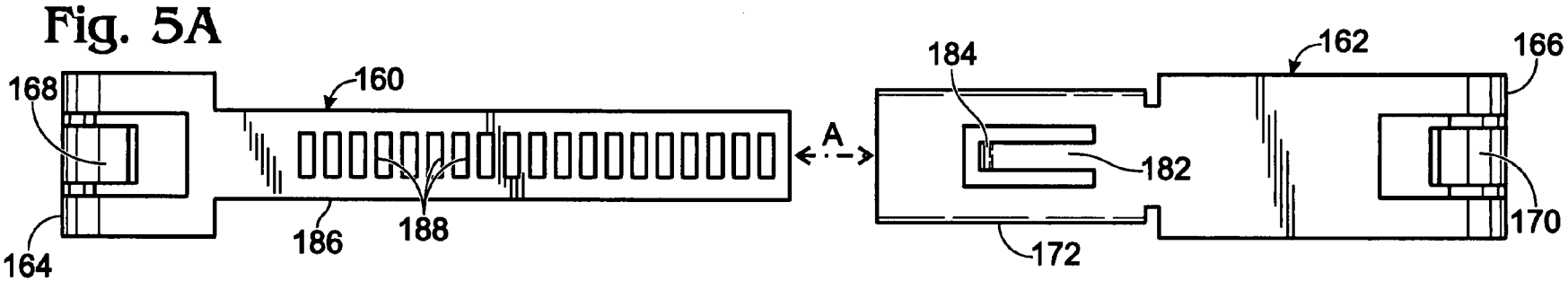
FIG. 5A is a top plan view of a protector support of FIG. 1, corresponding to the side view of FIG. 4A, showing portions of the support disengaged, in accordance with aspects of the present teachings.
Figure 5B:
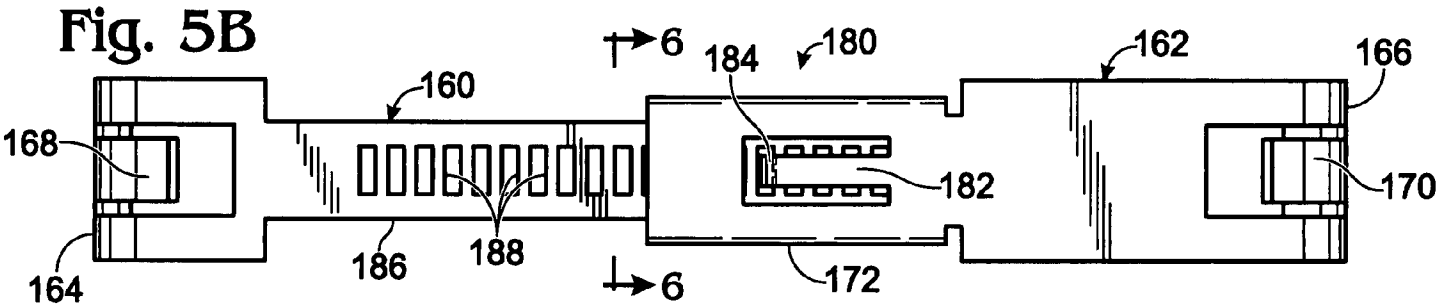
FIG. 5B is a top plan view of the protector support of FIG. 1, corresponding to the side view of FIG. 4B, showing portions of the support engaged, in accordance with aspects of the present teachings.

FIGS. 5A and 5B show top views of a protector support 120.

Slot portion 186 may include one or more slots 188, each sized to receive and retain a pin of adjustment arm 182. The number and location of slots 188 may determine, in part, how finely the gutter support length may be fixably adjusted. In particular, because the length of gutter protector 120 may be fixed by pin engagement into any slot that may be slidably positioned into the channel, lesser or greater numbers of slots 188 may correspond to lesser or greater numbers of support lengths that may be fixed or locked. The embodiment of FIGS. 5A and 5B shows a slot portion having multiple slots, allowing the protector support to be fixed a multiple lengths. In other embodiments, the slot portion may include only one or two or three slots, among others. For example, the slot portion may include three slots 188, positionable such that pin engagement of a first slot may fix the support length at a length that may attach to a 5-inch size gutter, pin engagement of a second slot may fix the support length at a length that may attach to a 4-inch size gutter, and pin engagement of a third slot may fix the support length at a length that may attach to a 3-inch size gutter. More generally, the slot portion may have slots positioned to fix a range of support lengths at increments such that the protector support may be attached to gutters in the range of 2-inches to 8-inches, or even larger.

Figure 6:
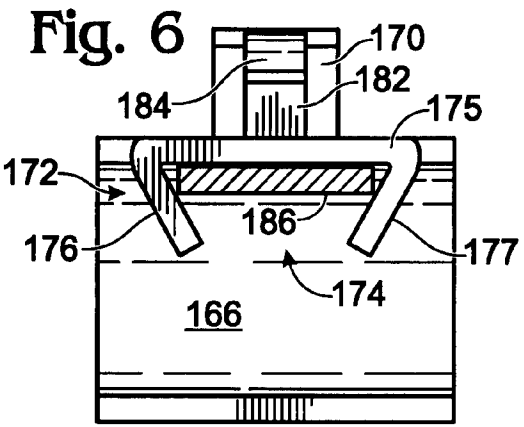
FIG. 6 is an exploded sectional view of the protector support of FIG. 4B fragmented approximately as shown in FIG. 5B along line 6-6, in accordance with aspects of the present teachings.

FIG. 6 is a sectional view of interconnection portion 180, taken generally along line 6-6 of FIG. 5B. The interconnection portion, as described above, includes slot portion 186 of first support member 160 and channel portion 172 of second support member 162. The channel portion, in turn, may include a channel 174 formed in part from a channel roof 175, a first channel side 176, and a second channel side 177. The channel may be configured to receive and slidably retain slot portion 186 of the first support member. One or more of the first and second channel sides may be positioned to form an acute angle at their respective junction with channel roof 175, which in part may function to guide and retain the slot portion inside the channel. The first and second channel sides may be formed when constructed in this angled configuration, and/or they may be bent after formation but before, during, and/or after receipt of the slot portion.

The channel roof may be configured to allow adjustment arm 182 of the channel portion to move into and out of contact with the slot portion, for example, with the adjustment arm at least partially positioned within channel roof 175. Thus, when adjustment arm 182 is moved from a disengaged configuration to an engaged configuration, a portion of the adjustment arm, which may include pin 184, may enter into channel 174. The angled relationship of the channel sides to the channel roof may prevent the slot portion from being pushed out of the channel by an applied force (in the direction of Arrow B of FIGS. 3, 4A and 4B) to bring the adjustment arm into a slot engaging position. Although FIG. 6 shows a "V-shaped" channel, or "V-guide," alternative embodiments may include differently shaped channels or guides, such as "C-shaped" channels, track channels, or cuff-sided channels, among others, all of which function to receive the slot portion of the first support member and permit the slidable adjustment of the slotted portion of the first support member and the channel or guide portion of the second support member, relative to one another.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure.

I claim:

1. A gutter assembly, comprising:

a half-round gutter including:

a first gutter lip with an exterior surface;

a second gutter lip including a bead with a curved exterior surface; and a trough;

wherein the first gutter lip and the second gutter lip define an opening to the trough and further define a gutter width;

a gutter protector adapted to reduce introduction of debris into the trough of the gutter, the gutter protector including a first edge portion and a second edge portion; and a plurality of gutter-protector supports, each gutter protector including:

a first support member including:

a retainer engaged with and at least partially circumscribing the exterior surface of the first gutter lip; and a first stay extending adjacent the retainer and engaged with and retaining the first edge portion of the gutter protector;

a second support member including:

a retention curve engaged with and at least partially circumscribing the curved exterior surface of the bead of the second gutter lip; and a second stay extending adjacent the retention curve and engaged with and retaining the second edge portion of the gutter protector; and an adjustable interconnection portion adapted to permit sliding of the first support member relative to the second support member to adjust an overall length of the gutter-protector support to correspond to the gutter width, the adjustable interconnection portion including means for selectively fixing the first support member relative to the second support member;

wherein each of the plurality of gutter-protector supports are retained and positioned on the gutter to span the opening of the trough of the gutter; and wherein the gutter protector is secured in a compressed convex state over the trough between the first and second stays of the plurality of gutter-protector supports, restricts debris from entering the trough of the gutter, and allows precipitation to flow into the trough of the gutter.

2. The gutter assembly of claim 1, wherein one of the first support member and the second support member includes a slot portion and a plurality of slots extending through the slot portion; and wherein the other of the first support member and the second support member includes a channel portion adapted to receive the slot portion in a slidable relation and an adjustment arm extending from the channel portion, the adjustment arm including a pin adapted to be selectively engaged with one of the plurality of slots, wherein when the pin is engaged with one of the plurality of slots the first and second support members are in a fixed relation to each other, and wherein when the pin is not engaged with one of the plurality of slots the first and second support members are in a slidable relation to each other.

3. The gutter assembly of claim 1, wherein the gutter protector includes at least one screen with apertures sized to restrict solid materials from entering the trough of the half-round gutter, while permitting precipitation to flow into the trough of the half-round gutter.

4. The gutter assembly of claim 1, wherein the retainer and the retention curve of the plurality of gutter-protector supports do not extend into the trough of the half-round gutter.

5. The gutter assembly of claim 1, wherein the second edge portion of the gutter protector extends at least partially over the second gutter lip to restrict accumulation of debris between the gutter protector and the second lip.

6. A method of installing a gutter protector in relation to a gutter adjacent a building's roof, the gutter having an opening defined by a first gutter lip and a second gutter lip spaced from the first gutter lip and defining a gutter width, the gutter further having a trough for conveying water received through the opening toward an outlet, and the gutter protector adapted to reduce the introduction of debris into the trough, the method comprising:

affixing a plurality of gutter-protector supports on the gutter;

affixing the gutter protector to the plurality of gutter-protector supports;

wherein each of the plurality of gutter-protector supports includes:

first and second retainers shaped to engage and at least partially circumscribe an exterior surface of the first and second gutter lips, respectively, of the gutter to secure and position the gutter-protector support in a selected position on the gutter;

first and second stays extending adjacent the first and second retainers, respectively, the first and second stays configured to engage first and second edge portions, respectively, of the gutter protector to retain the gutter protector on the respective gutter-protector support and to position the gutter protector over the trough of the gutter to restrict debris from entering the trough of the gutter;

a first support member including the first retainer and the first stay;

a second support member including the second retainer and the second stay; and an adjustable interconnection portion adapted to permit sliding of the first support member relative to the second support member to adjust an overall length of the respective gutter-protector support to correspond to the gutter width, the adjustable interconnection portion including means for selectively fixing the first support member relative to the second support member;

wherein affixing the plurality of gutter-protector supports on the gutter includes engaging the first and second retainers of each of the plurality of gutter-protector supports with the first and second gutter lips, respectively, so that the plurality of gutter-protector supports extend substantially on the outside of the trough;

wherein affixing the plurality of gutter-protector supports on the gutter further includes adjusting the overall length of each of the plurality of gutter-protector supports and fixing the first support member relative to the second support member of each of the plurality of gutter-protector supports; and wherein affixing the gutter protector to the plurality of gutter-protector supports includes engaging the first edge portion of the gutter protector with the first stay of each gutter-protector support and engaging the second edge portion of the gutter protector with the second stay of each gutter-protector support, so that the gutter protector is positioned over the trough to restrict debris from entering the trough.

7. The method of claim 6, wherein the first support member includes a slot portion and a plurality of slots extending through the slot portion; and wherein the second support member includes a channel portion adapted to receive the slot portion in a slidable relation and an adjustment arm extending from the channel portion, the adjustment arm including a pin adapted to be selectively engaged with one of the plurality of slots, wherein when the pin is engaged with one of the plurality of slots the first and second support members are in a fixed relation to each other, and wherein when the pin is not engaged with one of the plurality of slots the first and second support members are in a slidable relation to each other.

8. The method of claim 6, wherein the gutter protector includes at least one screen with apertures sized to restrict solid materials from entering the trough of the gutter, while permitting precipitation to flow into the trough of the gutter, after the affixing the gutter protector to the plurality of gutter-protector supports.

9. The method of claim 6, wherein after the affixing the plurality of gutter-protector supports on the gutter, the first and second retainers of the plurality of gutter-protector supports do not extend into the trough of the gutter.

* * * * *

UNITED STATES PATENT AND TRADEMARK OFFICE

CERTIFICATE OF CORRECTION

PATENT NO. : 7,624,541 B2
APPLICATION NO. : 11/122938
DATED : December 1, 2009
INVENTOR(S) : David L. Gentry It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 473 days.

Signed and Sealed this

Twenty-sixth Day of October, 2010

David J. Kappos

David J. Kappos
*Director of the United States Patent and Trademark Office*